US005325915A

United States Patent [19]

Fouts et al.

[11] Patent Number: 5,325,915

[45] Date of Patent: Jul. 5, 1994

[54] MODULAR COOLER

[75] Inventors: Robert E. Fouts, Rancho Palos Verdes; Craig Fouts, Encinitas; Earl J. Fouts, Rolling Hills, all of Calif.

[73] Assignee: Earl's Supply Co., Long Beach, Calif.

[21] Appl. No.: 91,997

[22] Filed: Jul. 14, 1993

[51] Int. Cl.[5] ..... F28F 3/08

[52] U.S. Cl. ..... 165/78; 165/144; 165/149; 165/906

[58] Field of Search ..... 165/78, 144, 145, 149, 165/152, 153

[56] References Cited

U.S. PATENT DOCUMENTS

| | | | |
|---|---|---|---|
| 530,317 | 12/1894 | Young . | |
| 1,795,774 | 3/1931 | Hart | 165/144 X |
| 1,816,111 | 7/1931 | De Ferranti et al. . | |
| 1,875,638 | 9/1932 | Modine | 165/144 X |
| 1,899,629 | 2/1933 | Morse . | |
| 1,918,211 | 7/1933 | Olson | 165/144 X |
| 1,945,394 | 1/1934 | Carraway et al. | 165/144 X |
| 2,044,457 | 6/1936 | Young | 257/151 |
| 2,124,787 | 7/1938 | Lachasse | 165/144 |
| 2,821,369 | 1/1958 | Hillard | 257/241 |
| 2,984,456 | 5/1961 | Young | 257/154 |
| 4,924,938 | 5/1990 | Plaschkes | 165/158 |
| 5,036,911 | 8/1991 | So et al. | 165/153 |

FOREIGN PATENT DOCUMENTS

| | | | |
|---|---|---|---|
| 662841 | 8/1929 | France | 165/144 |
| 850871 | 10/1960 | United Kingdom | 163/153 |
| 921446 | 3/1963 | United Kingdom | 165/153 |
| 3500571 | 11/1985 | United Kingdom | 165/153 |

OTHER PUBLICATIONS

"Automotive Industries" from the Automobile, Nov. 25, 1920 p. 1069 showing the Seppeler Truck Radiator.

*Primary Examiner*—Allen J. Flanigan

*Attorney, Agent, or Firm*—Poms, Smith, Lande & Rose

[57] ABSTRACT

A modular cooler having a plurality of units which can be interconnected in a leak proof manner yet providing fluid flow therebetween. The cooler can be an oil or transmission fluid cooler and any suitable number of units and any suitable number of units may be stacked. Thus, a single unit can be used in conjunction with like units to provide any desired degree of cooling. The coolers are interconnected by fluid tight members between stacked units and by a nipple assembly on the uppermost unit having an adjustable member coupled to a sealing member on the lowermost unit.

7 Claims, 4 Drawing Sheets

52
56
7
7
103
100
104
102
105
10
118
107
110
106
9
9
111
10
116
117
113
115
112
114

FIG. 7
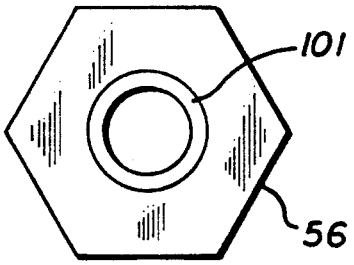
FIG. 8
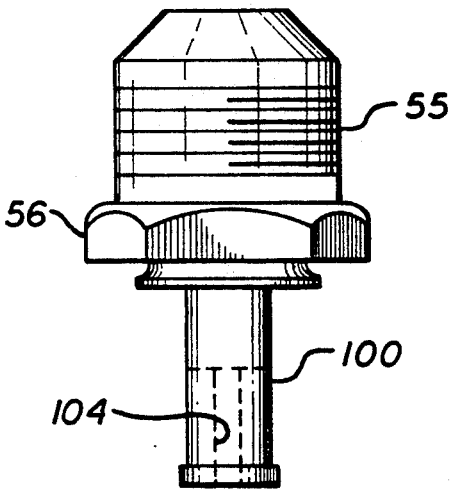
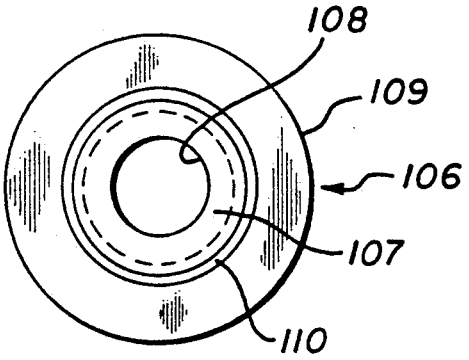
FIG. 9
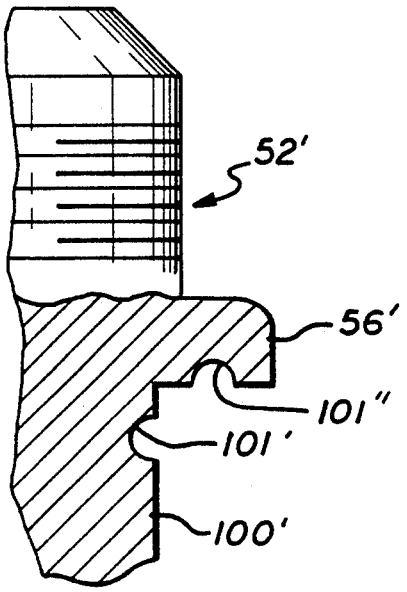
FIG. 10

MODULAR COOLER

BACKGROUND OF THE INVENTION

1. Field of the Invention

The invention relates to heat exchangers; and, more particularly, to a modular cooler comprised of a plurality of interconnected units.

2. Description of the Prior Art

Heat exchangers are well known in the art. Certain types are used to cool oil or transmission fluid in vehicles or the like. Depending on the capacity desired, a dealer in such coolers must store in inventory a number of such cooling capacities. There is thus a need for a cooler wherein various capacities may be attended to using only a single unit which can be coupled to one or more like units.

In U.S. Pat. No. 5,148,863, commonly assigned, there is disclosed such a modular cooler having a plurality of units which can be interconnected in a leak proof manner yet providing fluid flow therebetween. The cooler can be ah oil or transmission fluid cooler and any suitable number of units and any suitable number of units may be stacked. Thus, a single unit can be used in conjunction with like units to provide any desired degree of cooling.

Although the modular cooler in U.S. Pat. No. 5,148,863 works efficiently and well, the mating plates of individual units must be coupled together by U-shaped members having inwardly extending flanges. These members must be made to the proper tolerances and obviously add to the costs of inventory and parts. Further, there is a possibility that, in operation, such units, connected together in the manner shown in U.S. Pat. No. 5,148,863, might expand and distort in the area of the coils due to the manner in which the individual units are interconnected.

There is thus a need for a modular cooler comprised of a plurality of interconnected units where the units are held together in a manner adding strength to the interconnected units preventing distortion under pressure.

It is an object of this invention to carry out the foregoing object in a leak proof manner with fluid communication between the units while preventing distortion of the units when operating under pressure.

These and other objects of the invention are preferably accomplished by providing a modular cooler having a plurality of units which can be interconnected in a leak proof manner yet providing fluid flow therebetween. The cooler can be an oil or transmission fluid cooler and any suitable number of units may be stacked. Thus, a single unit can be used in conjunction with like units to provide any desired degree of cooling. The units are connected together by an immovable rod extending through the units which adds strength to the cooler and eliminates undesirable expansion and distortion when operating under pressure.

BRIEF DESCRIPTION OF THE DRAWING

FIG. 7 is a view taken along lines 7—7 of FIG. 6;

FIG. 8 is an elevational view of a modified seal in accordance with the teachings of the invention; and FIG. 9 is an elevational view of a pair of abutting plates having the seal of FIG. 8 sealing the plates.

DESCRIPTION OF THE PREFERRED EMBODIMENT

Figure 1:
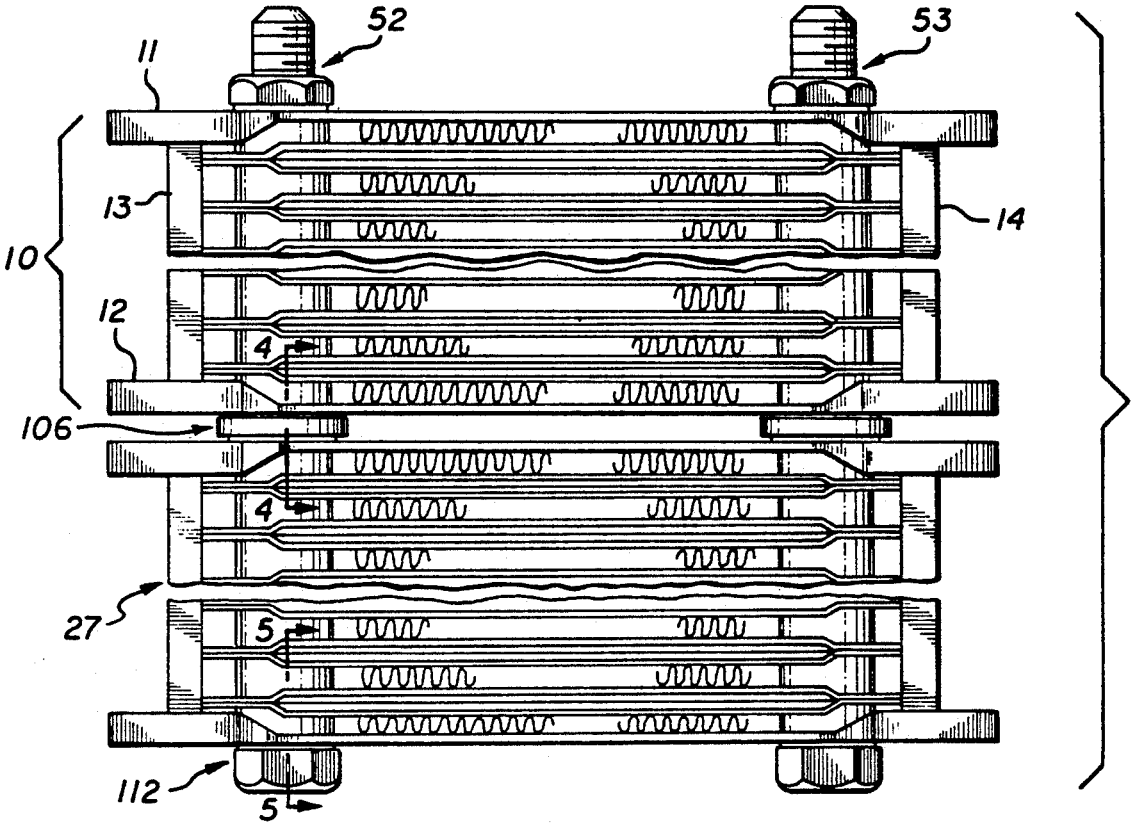
FIG. 1 is an elevational view of a cooler comprised of a plurality of interconnected units.

Referring now to FIG. 1 of the drawing, a modular cooler 27 is shown comprised of a plurality of interconnected cooling units 10. Each unit 10 is comprised of an upper plate 11 secured to a lower plate 12 by a pair of spaced end walls 13, 14. A plurality of cooling plates 15 (FIG. 3) extend between walls 13, 14, secured thereto in any suitable manner. Each plate 15 terminates in apertured end flanges 16' having a mid portion 16 comprised of spaced interconnected upper and lower members 17, 18 providing fluid communication therethrough. A coil 19 separates the cooling plates 15 from each other and upper and lower plates 11, 12.

Each upper and lower plate 11, 12 has a pair of spaced openings 20, 21.

Figure 3:
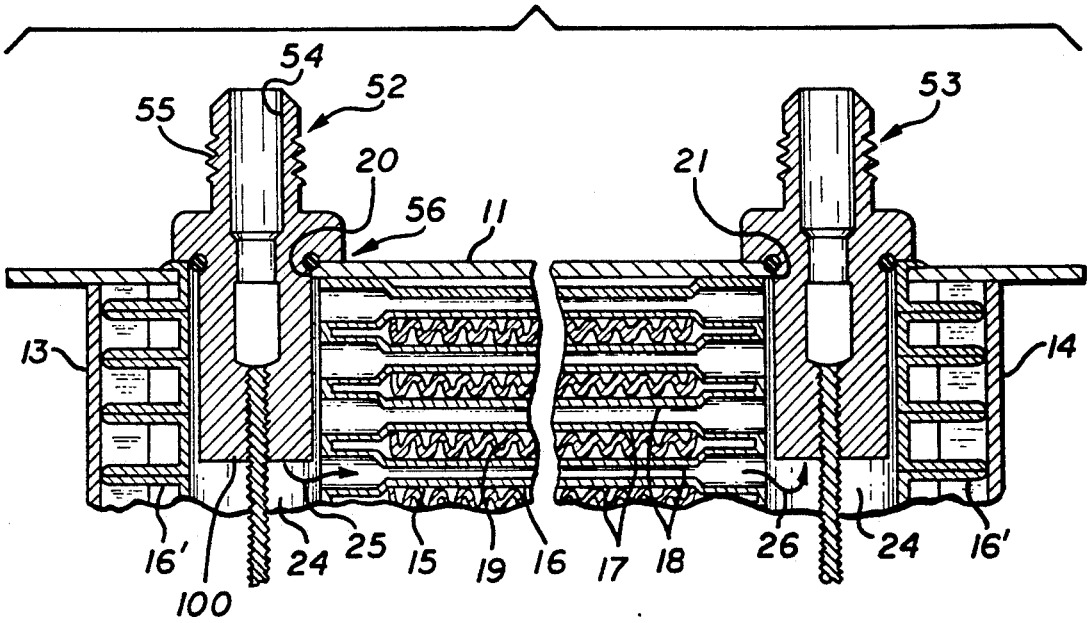
FIG. 3 is a view taken along lines 3—3 of FIG. 2.

The units 10 may be made of any suitable material, such as metal, coated or uncoated, and assembled in any suitable manner, such as gluing, welding, screws, bolts, etc. As seen in FIG. 3, it can be seen that generally cylindrical hollow tubing portions 24 separate each end flange 16' on each side of midportion 16 and in fluid communication therewith, the tubing sections 24 being axially aligned so that fluid can flow down opening 20 in upper plate 11, through tubing sections 24 and into midportions 16 and thus into the tubing sections 24 on both sides of plates 11, 12 as indicated by arrows 25, 26 in FIG. 3.

Figure 6:
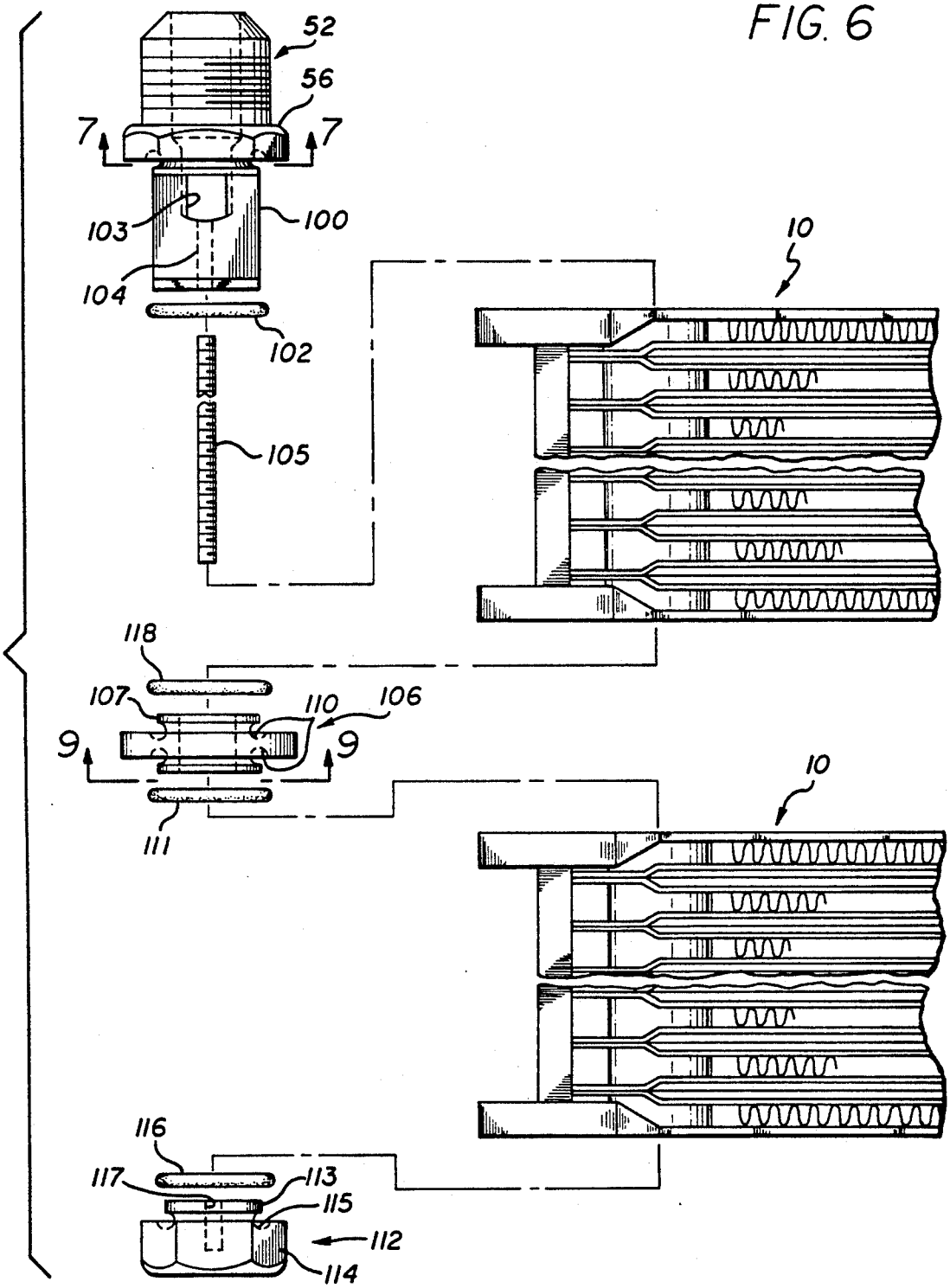
FIG. 6 is an exploded view of the unit of FIG. 1.

Obviously, fluid would flow out of the openings 20, 21 in the lower plate 12 if it were not closed off. However, as particularly contemplated in the present invention, and as shown in FIGS. 1 and 6, a plurality of units 10 can be interconnected to provide a modular cooler 27.

Thus, a pair of identical units 10 are shown. Units 10 may be of the same overall height but, as will be discussed, one unit may be higher than the other (having more cooling plates 15, e.g., one unit having eight plates and another unit having thirteen plates).

Figure 2:
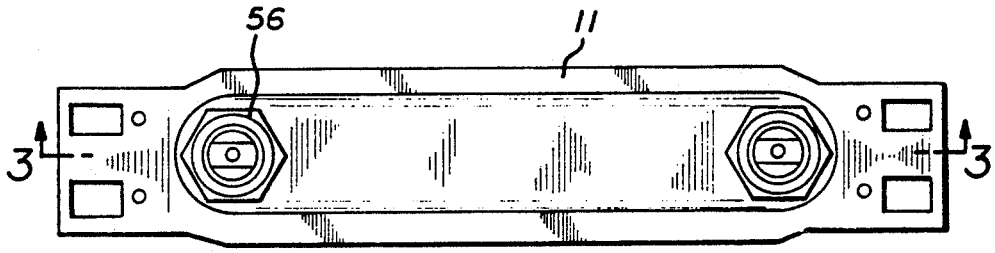
FIG. 2 is a top plan view of the cooler of FIG. 1.
Figure 4:
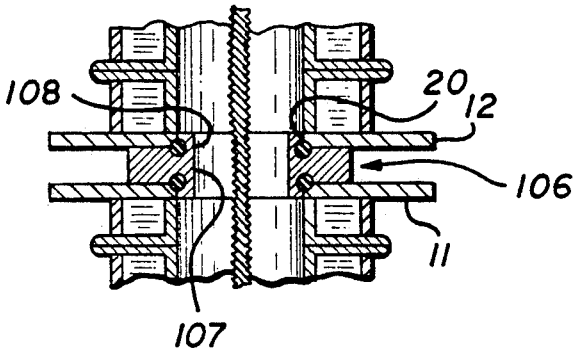
FIGS. 4 and 5 are views taken along lines 4—4 and 5—5 respectively, of FIG. 1.

A threaded nipple 52, 53 (FIG. 3) is provided at each opening 20, 21 in plate 11, each nipple 52, 53 having a throughbore 54 and an outer thread 55 with a hexagonally shaped integral nut 56 (FIGS. 2 and 8). Throughbores 54 are aligned with openings 20, 21 in top wall 11. Like openings 20, 21 are also formed in both wall 12 (see FIG. 4—only opening 20 being visible).

The nipples 52, 53 may be one integral piece. A suitable fluid conduit (not shown) may be coupled to each nipple 52, 53.

Nipples 52, 53 form part of the interconnecting means for interconnecting a plurality of units 10 as shown in FIG. 1. Thus, looking at FIG. 6, nipple 52 (nipple 53 being identical) has an integral insert portion 100 extending downwardly from nut 56. As seen in FIGS. 6 and 7, a groove 101 is provided at the junction of nut 56 and insert portion 100 for receiving a resilient O-ring 102 (FIG. 6) therein. As seen in FIG. 8, insert portion 100 may be narrower in one orientation thereof and, as seen in FIG. 6, has an opening 103 therethrough communicating with the throughbore 54 through nipple 52. A threaded hole 104 extends from opening 103 to the bottom thereof.

Nipple portions 55, 56 and 100 may be one integral piece or comprised of welded or glued parts. The width of insert portion 100 is such so that it can be inserted through openings 20, 21 as will be discussed. An elongated threaded rod 105 is provided adapted to thread into hole 104. Rod 105 is of an overall length to extend between abutting units 10 as seen in FIG. 1, and as will be discussed further.

A sealing member 106 (FIG. 6) is provided between abutting units 10. As seen in FIG. 9, each sealing member 106 has an inner cylindrical portion 107 with a throughbore 108 and an outer integral ring portion 109. The outer diameter of cylindrical portion 107 is related to the diameter of openings 20, 21.

A groove 110 is provided on each side of the intersection of portions 107, 109 (only one side visible in FIG. 9) for receiving resilient O-rings 110, 111 therein (see FIG. 6).

An end cap 112 is provided at the bottom of the lowermost unit 10. End cap 112 has an inner cylindrical portion 113 and an outer hexagonal shaped nut portion 114, of greater diameter than portion 113. The diameter of cylindrical portion 113 is related to the diameter of openings 20, 21. Portions 113 and 114 may be integral or of one piece with a groove 115 being provided in portion 144 where it intersects portion 113 for receiving a resilient O-ring 116 therein. A threaded hole 117 is provided in the center of cylindrical portion 113 for threadably receiving rod 105 therein.

In assembly of the units 10 to form a cooler 27, as seen in FIG. 1, the upper unit 10 in FIG. 1 is placed against the lower unit 10, walls 12 of upper unit 10 being adjacent wall 11 of lower unit 10 with sealing members 106 disposed in aligned openings 20, 21 in both the upper and lower units. The cylindrical portion 107 enters adjacent aligned openings 20, 21 and O-rings 110, 111 seal off the two abutting units 10 (see FIG. 4).

O-ring 102 is inserted into groove 101 of nipple 52 and rod 105 is threaded into hole 104. Rod 105 is now extended down through the aligned openings, such as openings 21 in upper and lower units 10, with insert portion 100 entering the uppermost opening 21 as can be seen in FIG. 3.

Figure 5:
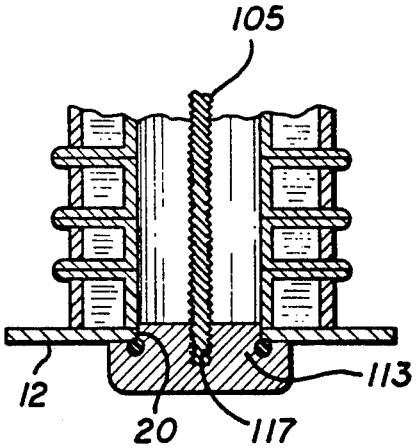

The lowermost end of rod 105, as seen in FIG. 5 is now threaded into hole 117 in cylindrical portion 113, the latter being disposed in the opening 20 in lowermost unit 10. Tightening nut portion 114 tightens the two units of FIG. 1 together in a fluid tight manner.

Although two units 10 are shown in FIG. 1, obviously a plurality of such units 10 can be modularly stacked and assembled using lower threaded rods 105. Coolant is flowed through nipple 52, down through the aligned tubing sections 24 and openings 20, 21 and through the midportions 16 back out of nipple 53 as is well known in the cooling art.

The modular system 27 disclosed herein can be used to cool oil, transmission fluid, etc. They can be used anywhere it is necessary to generate a lot of heat, such as in x-ray machines. That is, the fluid passing through the coils of the cooler may be air. The need for carrying a plurality of different cooling units of cooling capacities is substantially reduced since units 10 can be stacked and quickly assembled to obtain any desired coolant capacity.

Although O-rings and mating grooves have been indicated as sealing means between the units 10, obviously other means can be used. Further, any suitable sealing means may be used. Although a preferred O-ring groove 110 is shown in FIG. 6, obviously different locations for such grooves may be provided. In fact, such grooves may be provided as shown in FIG. 10 wherein a modified nipple 52' is shown having a first groove 101' on the outside of insert portion 100' and a second groove 101'' on the underside of nut portion 56' for receiving O-rings therein.

It can be seen that the threaded rod 105 and nipples 52 and end cap 112 arrangement replaces many parts necessary in U.S Pat. No. 5,148,863 for retaining a plurality of units together in a fluid-tight manner. The immovable rod 105, when tightened, keeps the sections from expanding and distorting.

The large opening 103 in insert portions 100 allows as much cooling fluid to flow out through that opening into the interior of the units 10 as enters through the throughbore 54 in nipple 52. Thus, there is no restriction to the flow of coolant.

There is thus disclosed an improved modular cooler which is comprised of a plurality of units which can be quickly and easily assembled together using less connecting parts that prior art coolers and eliminating distortion to the coolers when operating under pressure.

Although a particular embodiment of the invention has been disclosed, the means for carrying out the invention described herein may be modified by an artisan and the scope of the invention is only to be limited by the scope of the amended claims.

I claim:

1. In a modular cooler comprised of a plurality of interconnected units, each of said units comprising an upper plate and a lower plate, a pair of spaced end walls secured to said upper and lower plates, a plurality of spaced cooling plates mounted below said upper plate, above said lower plate and between said end walls and secured thereto, each of said cooling plates having a hollow midbody portion with integral flanges at each end of said midbody portion, with apertures, therethrough, said apertures in said flanges being in fluid communication with the interior of said midbody portion, a pair of spaced openings in each of said upper and lower plates, one of said openings being on one side of said upper and lower plates and the other of said openings being on the other side of said upper and lower plates, the openings on said one side of said lower plates being aligned with the openings on said one side of said upper plates and with said apertures extending through one of said flanges with the other of said openings in said upper and lower plates being aligned with each other and with the apertures in the other of said flanges whereby fluid communication is provided from said one of said openings in one of said upper plates, through said aligned apertures in one of said flanges, through said midbody portions and out said other of said aligned apertures in the other of said flanges and through said other of said openings in said upper and lower plates, one of said units being secured in a fluid-tight manner to another of said units with the lower plate of one of said units being disposed adjacent the upper plate of another of said units, the improvement which comprises:

fluid tight sealing means being mounted in each of said openings in both the lower plate of one of said units and the upper plate of said another of said units; and a nipple assembly mounted in a fluid tight manner in each of said openings in the upper plate of one of said units, each of said nipple assemblies including an insert portion extending downwardly through said respective ones of said openings with an adjustable member coupled to each of said insert portions and to a fluid tight sealing member mounted in said aligned openings in the lower plate of said another of said units, each of said nipple assemblies having a throughbore extending therethrough in fluid communication with both an opening through said insert portion and said apertures through said flanges aligned with respective ones of said openings, said adjustable member being a threaded rod extending through aligned openings and aligned flanges on both sides of said cooler, said threaded rod being threaded at one end in a threaded hole in said insert portion and at the other end in a threaded hole in said cylindrical portion, said threaded rod being threaded substantially along the entire length thereof between said insert portion and said cylindrical portion whereby tightening the same draws said units together in a tight fluid tight relationship.

2. In the cooler of claim 1 including a threaded nipple on each of said nipple assemblies extending away from said cooler.

3. In a modular cooler comprised of a plurality of interconnected units, each of said units comprising an upper plate and a lower plate, a pair of spaced end walls secured to said upper and lower plates, a plurality of spaced cooling plates mounted below said upper plate, above said lower plate and between said end walls and secured thereto, each of said cooling plates having a hollow midbody portion with integral flanges at each end of said midbody portion, with apertures therethrough, said apertures in said flanges being in fluid communication with the interior of said midbody portion, a pair of spaced openings in each of said upper and lower plates, one of said openings being on one side of said upper and lower plates and the other of said openings being on the other side of said upper and lower plates, the openings on said one side of said lower plates being aligned with the openings on said one side of said upper plates and with said apertures extending through one of said flanges with the other of said openings in said upper and lower plates being aligned with each other and with the apertures in the other of said flanges whereby fluid communication is provided form said one of said openings through said aligned apertures, in one of said flanges, through said midbody portions and out of said other of said aligned apertures in the other of said flanges and through said other of said openings in said upper and lower plates, one of said units being secured in a fluid-tight manner to another of said units with the lower plate of one of said units being disposed adjacent the upper plate of another of said units, the improvement which comprises:

fluid tight sealing means being mounted in each of said openings in both the lower plate of one of said units and the upper plate of said another of said units;

a nipple assembly mounted in a fluid tight manner in each of said openings in the upper plate of one of said units, each of said nipple assemblies including an insert portion extending downwardly through said respective ones of said openings with an adjustable member coupled to each of said insert portions and to a fluid tight sealing member mounted in said aligned openings in the lower plate of said another of said units, each of said nipple assemblies having a throughbore extending therethrough in fluid communication with both an opening through said insert portion and said apertures through said flanges aligned with respective ones of said openings; and a threaded nipple on each of said nipple assemblies extending away from said cooler, said nipples being mounted to a nut coupled to said insert portion.

4. In the cooler of claim 3 including a circular groove disposed at the junction of said nut and said nipple with a resilient O-ring disposed in said groove.

5. In the cooler of claim 1 wherein the opening through said insert portion is wide enough to allow substantially as much fluid to flow therethrough as flows through said throughbore.

6. In a modular cooler comprised of a plurality of interconnected units, each of said units comprising an upper plate and a lower plate, a pair of spaced end walls secured to said upper and lower plates, a plurality of spaced cooling plates mounted below said upper plate, above said lower plate and between said end walls and secured thereto, each of said cooling plates having a hollow midbody portion with integral flanges at each end of said midbody portion, with apertures therethrough, said apertures in said flanges being in fluid communication with the interior of said midbody portion, a pair of spaced openings in each of said upper and lower plates, one of said openings being on one side of said upper and lower plates and the other of said openings being on the other side of said upper and lower plates, the openings on said one side of said lower plates being aligned with the openings on said one side of said upper plates and with said apertures extending through one of said flanges with the other of said openings in said upper and lower plates being aligned with each other and with the apertures in the other of said flanges whereby fluid communication is provided form said one of said openings through said aligned apertures, in one of said flanges, through said midbody portions and out of said other of said aligned aperture sin the other of said flanges and through said other of said openings in said upper and lower plates, one of said units being secured in a fluid-tight manner to another of said units with the lower plate of one of said units being disposed adjacent the upper plate of another of said units, the improvement which comprises:

fluid tight sealing means being mounted in each of said openings in both the lower plate of one of said units and the upper plate of said another of said units; and a nipple assembly mounted in a fluid tight manner in each of said openings in the upper plate of one of said units, each of said nipple assemblies including an insert portion extending downwardly through said respective ones of said openings with an adjustable member coupled to each of said insert portions and to a fluid tight sealing member mounted in said aligned openings in the lower plate of said another of said units, each of said nipple assemblies having a throughbore extending therethrough in fluid communication with both an opening through said insert portion and said apertures through said flanges aligned with respective ones of said openings; and said fluid tight sealing means being a cylindrical member disposed in said opening having an outer ring of greater diameter than said cylindrical member with a groove associated with both said ring and said cylindrical member, and a resilient O-ring disposed in said groove.

7. In a modular cooler comprised of a plurality of interconnected units, each of said units comprising an upper plate and a lower plate, a pair of spaced end walls secured to said upper and lower plates, a plurality of spaced cooling plates mounted below said upper plate, above said lower plate and between said end walls and secured thereto, each of said cooling plates having a hollow midbody portion with integral flanges at each end of said midbody portion, with apertures therethrough, said apertures in said flanges being in fluid communication with the interior of said midbody portion, a pair of spaced openings in each of said upper and lower plates, one of said openings being on one side of said upper and lower plates and the other of said openings being on the other side of said upper and lower plates, the openings on said one side of said lower plates being aligned with the openings on said one side of said upper plates and with said apertures extending through one of said flanges with the other of said openings in said upper and lower plates being aligned with each other and with the apertures in the other of said flanges whereby fluid communication is provided form said one of said openings through said aligned apertures, in one of said flanges, through said midbody portions and out of said other of said aligned apertures in the other of said flanges and through said other of said openings in said upper and lower plates, one of said units being secured in a fluid-tight manner to another of said units with the lower plate of one of said units being disposed adjacent the upper plate of another of said units, the improvement which comprises:

fluid tight sealing means being mounted in each of said openings in both the lower plate of one of said units and the upper plate of said another of said units; and a nipple assembly mounted in a fluid tight manner in each of said openings in the upper plate of one of said units, each of said nipple assemblies including an insert portion extending downwardly through said respective ones of said openings with an adjustable member coupled to each of said insert portions and to a fluid tight sealing member mounted in said aligned openings in the lower plate of said another of said units, each of said nipple assemblies having a throughbore extending therethrough in fluid communication with both an opening through said insert portion and said apertures through said flanges aligned with respective ones of said openings; and said fluid tight sealing member including a cylindrical portion mounted in said opening receiving said adjustable member therein, and an integral nut portion surrounding said cylindrical portion and integral therewith, a groove associated with both said cylindrical portion and said nut, and a resilient O-ring mounted in said groove.

* * * * *